US010961803B2

(12) United States Patent
Budde

(10) Patent No.: US 10,961,803 B2
(45) Date of Patent: Mar. 30, 2021

(54) MULTI-FUNCTION DART

(71) Applicant: WEATHERFORD TECHNOLOGY HOLDINGS, LLC, Houston, TX (US)

(72) Inventor: Marcel Budde, Vlaardingen (NL)

(73) Assignee: Weatherford Technology Holdings, LLC, Houston, TX (US)

( * ) Notice: Subject to any disclaimer, the term of this patent is extended or adjusted under 35 U.S.C. 154(b) by 198 days.

(21) Appl. No.: 15/574,409

(22) PCT Filed: May 26, 2016

(86) PCT No.: PCT/US2016/034382
§ 371 (c)(1),
(2) Date: Nov. 15, 2017

(87) PCT Pub. No.: WO2016/191578
PCT Pub. Date: Dec. 1, 2016

(65) Prior Publication Data

US 2018/0135378 A1 May 17, 2018

Related U.S. Application Data

(60) Provisional application No. 62/166,514, filed on May 26, 2015.

(51) Int. Cl.

| | |
|---|---|
| ***E21B 33/12*** | (2006.01) |
| ***E21B 43/10*** | (2006.01) |
| ***E21B 33/16*** | (2006.01) |
| ***E21B 33/04*** | (2006.01) |
| ***E21B 23/04*** | (2006.01) |

(52) U.S. Cl.
CPC ..... *E21B 33/12* (2013.01); *E21B 23/04* (2013.01); *E21B 33/04* (2013.01); *E21B 33/16* (2013.01); *E21B 43/10* (2013.01)

(58) Field of Classification Search
CPC ..... E21B 33/12; E21B 33/04
USPC ..... 166/285
See application file for complete search history.

(56) References Cited

U.S. PATENT DOCUMENTS

| | | | |
|---|---|---|---|
| 5,553,667 | A | 9/1996 | Budde et al. |
| 5,787,979 | A | 8/1998 | Giroux et al. |
| 5,813,457 | A | 9/1998 | Giroux et al. |
| 6,009,944 | A | 1/2000 | Gudmestad |

(Continued)

FOREIGN PATENT DOCUMENTS

WO 2012065126 A2 5/2012

OTHER PUBLICATIONS

International Search Report and Written Opinion, PCT/US2016/034382, dated Aug. 5, 2016.

(Continued)

*Primary Examiner* — William D Hutton, Jr.
*Assistant Examiner* — Ashish K Varma
(74) *Attorney, Agent, or Firm* — Patterson + Sheridan, LLP

(57) ABSTRACT

Methods and apparatus are provided for cementing a liner. In one embodiment, the method includes releasing a dart behind a cement; landing the dart in an activation seat; increasing pressure to activate a liner hanger; further increasing pressure to release the dart from the activation seat; landing the dart in a plug; and increasing pressure to release the dart and the plug. In one embodiment, releasing the dart from the activation seat comprises deforming the dart.

23 Claims, 4 Drawing Sheets

(56) References Cited

U.S. PATENT DOCUMENTS

| | | | | |
|---|---|---|---|---|
| 6,244,350 | B1 | 6/2001 | Gudmestad et al. | |
| 6,311,771 | B1 | 11/2001 | Gudmestad et al. | |
| 6,419,015 | B1 | 7/2002 | Budde et al. | |
| 6,799,638 | B2 | 10/2004 | Butterfield, Jr. | |
| 6,802,372 | B2 | 10/2004 | Budde | |
| 7,182,135 | B2 * | 2/2007 | Szarka | E21B 33/16 166/265 |
| 8,327,937 | B2 | 12/2012 | Giem et al. | |
| 8,789,582 | B2 | 7/2014 | Rondeau et al. | |
| 2012/0175133 | A1 * | 7/2012 | Nikiforuk | E21B 33/16 166/386 |
| 2013/0112410 | A1 | 5/2013 | Szarka et al. | |
| 2014/0196912 | A1 * | 7/2014 | Turley | E21B 43/10 166/382 |
| 2018/0023362 | A1 | 1/2018 | Makowiecki et al. | |
| 2019/0128087 | A1 | 5/2019 | Stair et al. | |

OTHER PUBLICATIONS

EPO Examination Report dated Dec. 3, 2018, for European Application No. 16727125.3.
EPO Office Action dated Oct. 25, 2019, for European Patent Application No. 16727125.3.
Brazilian Office Action dated Jun. 16, 2020, for Brazilian Patent Application No. BR112017024469-1.
Australian Office Action dated Jun. 26, 2020, for Australian Patent Application No. 2016268394.
Australian Office Action dated May 16, 2020, for Australian Patent Application No. 2016268394.
Canadian Office Action dated Jan. 12, 2021 in related Canadian Patent Application No. 2,985,200.

* cited by examiner

MULTI-FUNCTION DART

BACKGROUND OF THE INVENTION

Field of the Invention

Embodiments of the present invention relate to apparatus and methods of cementing a tubular. Particularly, embodiments disclosed herein relate to a multi-function dart for activating a liner hanger and activating a wiper plug.

Description of the Related Art

A wellbore is formed to access hydrocarbon bearing formations, e.g. crude oil and/or natural gas, or geothermal formations by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

The liner string is typically deployed to a desired depth in the wellbore using a workstring. A setting tool of the liner string is then operated to set a hanger of the liner string against a previously installed casing string. The liner hanger may include slips riding outwardly on cones in order to frictionally engage the surrounding casing string. The setting tool is typically operated by pumping a ball through the workstring to a seat located below the setting tool. Pressure is exerted on the seated ball to operate the setting tool. Thereafter, pressure is increased to release the ball and the ball seat.

In some instances, the ball can generate kinetic energy when landing due to flow rates being too high. As a result, the ball may damage the ball seat shear rings such that the ball seat may be released at a lower force. There is, therefore, a need for an apparatus and method of hydraulically setting a liner hanger.

SUMMARY OF THE INVENTION

Embodiments of the present invention generally relate to a method of cementing a liner. In one embodiment, the method includes releasing a dart behind a cement; landing the dart in an activation seat; increasing pressure to activate a liner hanger; further increasing pressure to release the dart from the activation seat; and landing the dart in a plug. In one embodiment, releasing the dart from the activation seat comprises deforming the dart.

In another embodiment, a method of cementing a liner includes releasing a first dart in front of a cement; releasing a second dart behind the cement; landing the second dart in an activation seat; activating a liner hanger; releasing the second dart from the activation seat; landing the first dart in a first plug; releasing the first dart and the first plug; landing the second dart in a second plug; releasing the second dart and the plug; and disposing the cement on an exterior of the liner.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1C illustrates an exemplary liner string being run-in.

DETAILED DESCRIPTION

Figure 1A:
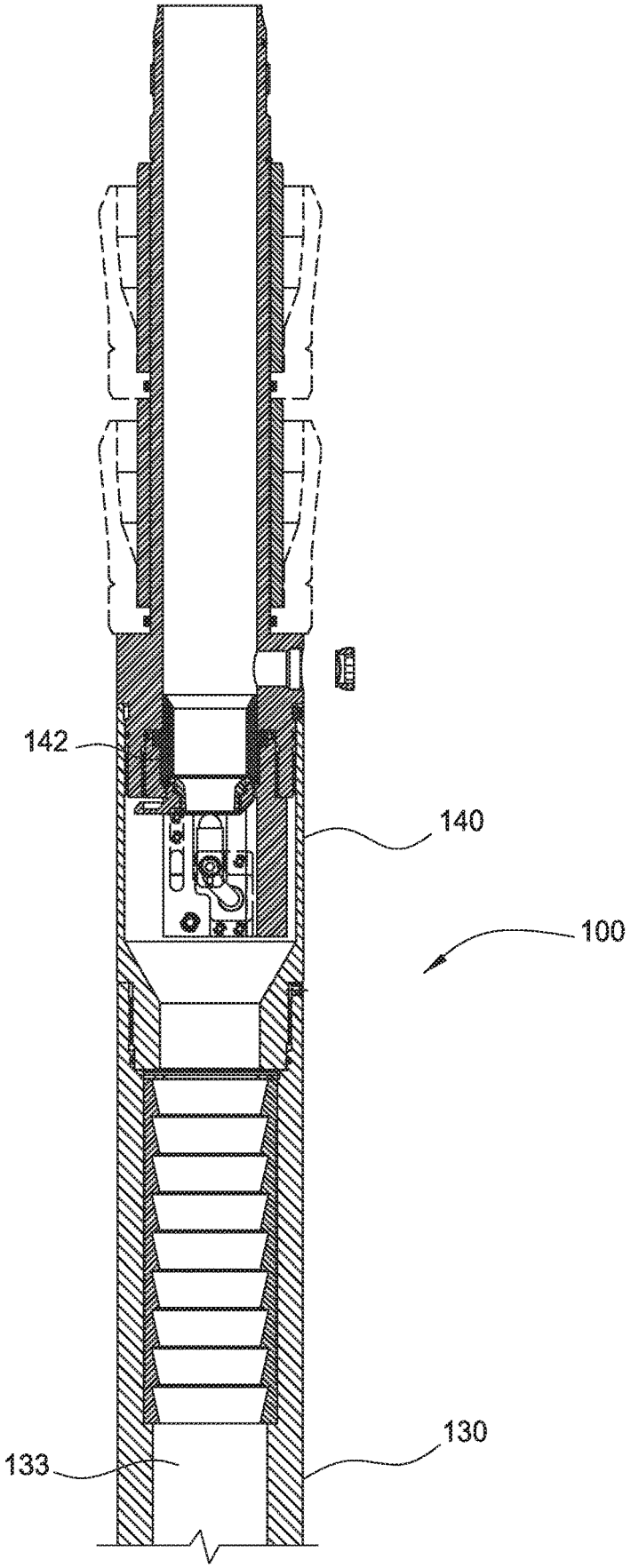
FIGS. 1A-1B illustrate an exemplary the plug release system 100 suitable for use in setting and cementing a liner.
Figure 1B:
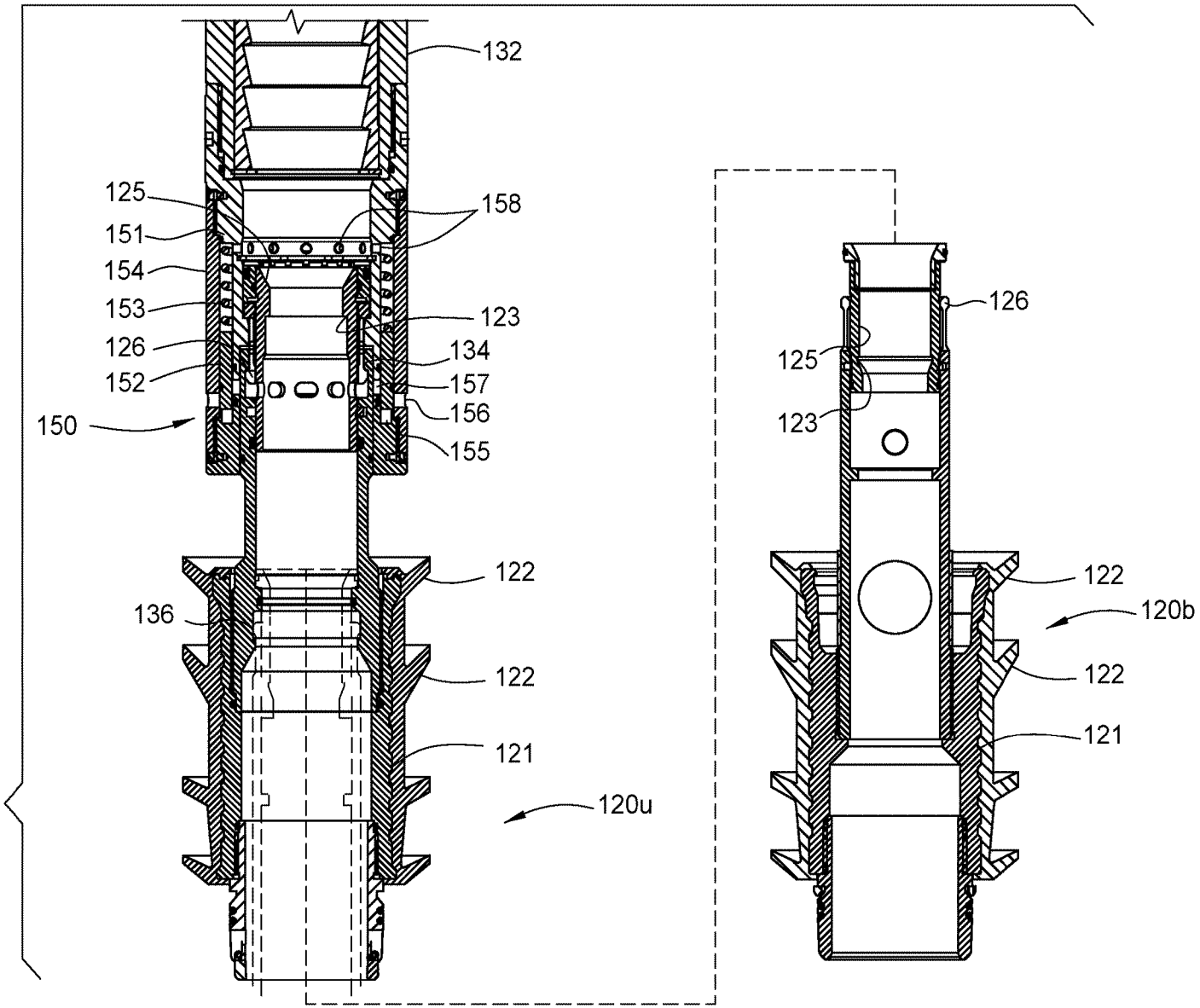

FIGS. 1A-1B illustrate an exemplary plug release system 100 suitable for use in setting and cementing a liner. For example, the plug release system may be used in the liner deployment assembly disclosed in U.S. Patent Application Publication No. 2014/0196912, filed Jan. 14, 2014, which patent application is incorporated herein by reference in its entirety, and in particular, the description and figures related to FIGS. 2A to 2D, FIGS. 5A to 5J, and FIGS. 6A to 6J.

Figure 1C:
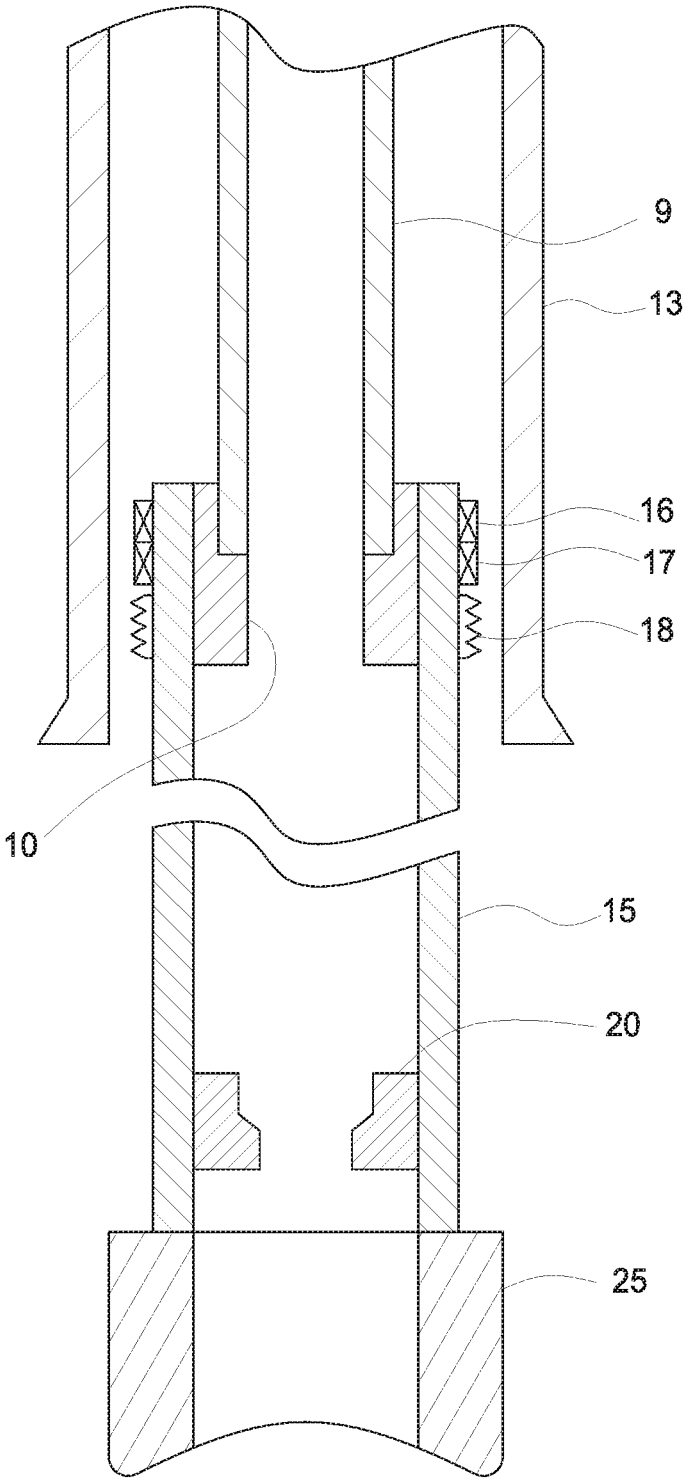

FIG. 1C illustrates a liner string 15 being run-in using a deployment string 9 made of drill pipe. The liner string 15 is run inside a casing 13. A liner deployment assembly 10 interconnects the deployment string 9 and the liner string 15. The liner string 15 may include a polished bore receptacle (PBR) 16, a packer 17, a liner hanger 18, a landing collar 20, and a reamer shoe 25. The reamer shoe 25 may be rotated by the top drive via the deployment string 9. The liner deployment assembly 10 includes a setting tool, a running tool, a catcher 140 and a plug release system 100. The setting tool may be used to set the liner hanger 18 and the packer 17. An upper end of the setting tool may be connected to a lower end the drill pipe 9, such as by threaded couplings. A lower end of the setting tool may be fastened to an upper end of the running tool, which is attached to the liner string 15. An upper end of the catcher 140 may be connected to a lower end of the running tool, and a lower end of the catcher 140 may be connected to an upper end of the plug release system 100, such as by threaded couplings.

Referring to FIGS. 1A-1B, the plug release system 100 includes a launcher 130, a relief valve 150, and one or more cementing plugs, such as a top wiper plug 120*u* and a bottom wiper plug 120*b*. Each of the launcher 130 and the wiper plugs 120*u,b* may be a tubular member having a bore formed therethrough. The launcher 130 may include a housing 132 and an upper latch profile 134. The housing 132 may include two or more tubular sections connected to each other, such as by threaded couplings. The housing 132 may have a coupling, such as a threaded coupling, formed at an upper end thereof for connection to the catcher 140.

The relief valve 150 may include a body 151, a piston 152, a biasing member 153, such as a compression spring, and a sleeve 154. The body 151 is connected to the launcher housing 132, and the sleeve 154 is connected to the body 151. The piston 152 and spring 153 may be disposed in a chamber 155 formed between the valve body 151 and the sleeve 154. The sleeve 154 may have an inlet port 156 formed therethrough for providing selective fluid communication between the exterior of the valve 150 and the chamber 155. An outlet port 157 may be formed through the body 151 for providing fluid communication between the chamber 155 and a bore 133 of the launcher 130. An equalization port 158 may be formed through a wall of the body 151 for providing fluid communication between an upper face of the piston 152 and the launcher bore 133.

The relief valve piston 152 may be longitudinally movable in the chamber 155 and relative to the valve body 151 between an upper open position and a lower closed position (FIG. 1B). The spring 153 may be disposed between an upper face of the piston 152 and an upper end of the chamber 155, thereby biasing the piston 152 toward the lower closed position. The piston 152 may move to the upper open position in response to the exterior pressure of the valve 150 being greater than the pressure in the launcher bore 133 by a pressure differential sufficient to overcome a biasing force of the spring 153. The spring 153 may be configured such that the biasing force may be overcome by a pressure differential between thirty psi and one hundred psi. The body 151 may carry two seals straddling the outlet port 157, and the piston 152 may include a seal disposed above the inlet port 156. The piston 152 may be clear of the outlet port 157 when the piston 152 is in the upper open position, thereby allowing fluid communication between the inlet port 156 and the outlet port 157. Alternatively, the spring 153 may have a nominal stiffness or be omitted, and the valve may function as a check valve instead of a relief valve.

Each wiper plug 120*u,b* may include a body 121 and a plurality of wiper seals 122. Each body 121 may have a latch 126 for engagement with a respective latch profile 134, 136. The latch 126 of the top wiper plug 120*u* is configured to engage the upper latch profile 134 in the launcher 130, and the latch 126 of the bottom wiper plug 120*b* is configured to engage the lower latch profile 136 of the top wiper plug 120*u*. Each plug body 121 may further have a landing profile 125 formed in an inner surface thereof. Each landing profile 125 may have a landing seat, an inner latch profile 123, and a seal bore for receiving the respective dart 243*u,b*. Each plug body 121 may be made from a drillable material, such as cast iron, nonferrous metal or alloy, fiber reinforced composite, or engineering polymer, and each wiper seal may be made from an elastomer or elastomeric copolymer.

The catcher 140 is configured to receive a dart. In one embodiment, the catcher 140 includes a catcher sleeve 142 for catching the dart. After the dart is caught, fluid flow through the bore 133 of the launcher 130 is blocked. The dart may be released from the catcher sleeve 142 by a threshold pressure exerted on the dart. The threshold pressure may be greater than a pressure required to set the liner hanger or perform other suitable operations. Upon reaching the threshold pressure, the dart may be urged through the catcher sleeve 142, thereby reopening fluid communication through the launcher bore 133.

Figure 2:
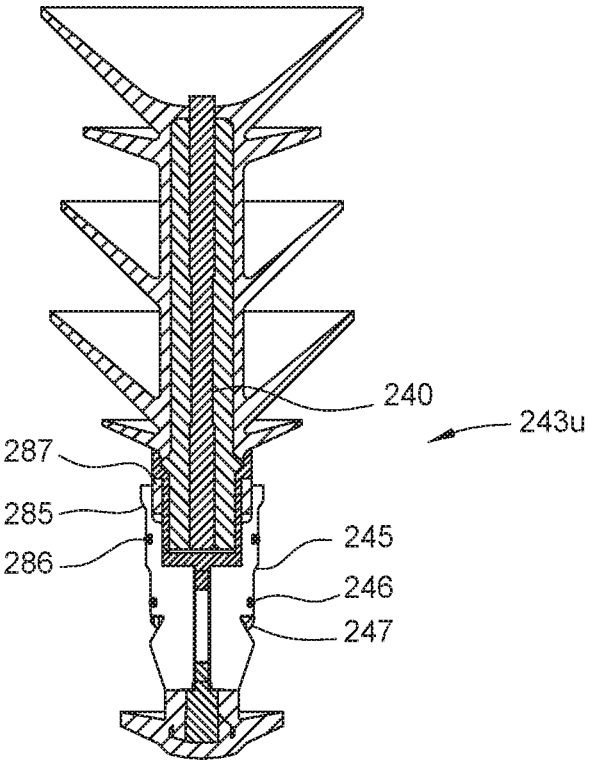
FIG. 2 shows an exemplary embodiment of a top dart and a bottom dart.
Figure 2:
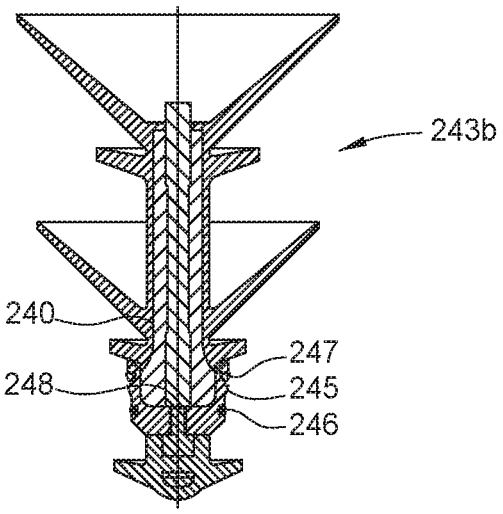

FIG. 2 illustrates an exemplary embodiment of a top dart 243*u* and a bottom dart 243*b*. Each dart 243*u,b* may have a complementary landing shoulder 245, landing seal 246, and a fastener 247 for engaging the respective inner latch profile 123, thereby connecting the dart 243*u,b* and the respective wiper plug 120*u,b*. The bottom dart 243*b* may have a hollow body 240 closed by a diaphragm 248, which may be caused to rupture after seating of the bottom dart 243*b* and plug 120*b* onto the float collar. The bottom dart 243*b* is configured to pass through top wiper plug 120*u* without engaging its inner latch profile 123. For example, the outer diameter of the shoulder 245 of the bottom dart 243*b* is smaller than the inner diameter of the top wiper plug 120*u* such that the bottom dart 243*b* will not be caught inside the top wiper plug 120*u*.

In one embodiment, the top dart 243*u* is configured to engage the top wiper plug 120*a* and the catcher sleeve 142. As shown in FIG. 2, the top dart 243*u* has a second landing shoulder 285 and a second landing seal 286. The second landing shoulder 285 is configured to engage the catcher sleeve 142 and the second landing seal 286 is configured to sealingly engage an inner diameter of the catcher sleeve 142. In this example, the second landing shoulder 285 has an outer diameter that is larger than the first landing shoulder 245. In one embodiment, the second landing shoulder 285 is deformable. For example, the second landing shoulder 285 can deform inwardly to reduce its outer diameter to a size smaller than the inner diameter of the catcher sleeve 142. In this respect, the top dart 243*u* may be released from the catcher sleeve 142. In this embodiment, the second landing shoulder 285 can deform inwardly in response to a predetermined pressure. The deformed second landing shoulder 285 may be received in a recess 287 formed in the outer surface of the dart body 240. The first landing shoulder 245 is configured to engage the inner latch profile 123 of the top plug 120*a* after the top dart 243*u* is release from the catcher sleeve 142.

Embodiments of the plug release system 100 may be used to cement a liner. In one embodiment, a liner string is advanced into the wellbore by a workstring. Once the liner string has been advanced to a desired deployment depth, fluid such as a drilling fluid or a conditioner may be circulated in front of the cement.

Initially, the bottom dart 243*b* is released to travel down the wellbore. Cement slurry may be pumped behind the bottom dart 243*b* to urge the bottom dart 243*b* downward.

After the desired quantity of cement slurry has been pumped, the top dart 243*u* is released to travel down the wellbore behind the cement slurry. Chaser fluid such as drilling fluid or conditioner may be pumped behind the top dart 243*u*, thereby propelling the top dart 243*u* downward. The train of darts 243*u,b* and cement slurry may be driven through the workstring by the chaser fluid.

The bottom dart 243*b* will pass through the catcher sleeve 142 and the top wiper plug 120*u* before reaching the bottom wiper plug 120*b* and seating therein. In this example, the landing shoulder 245 of the bottom dart 243*b* will engage the seat of the landing profile 125 of the bottom wiper plug 120*b*, and the fastener 247 will engage the latch profile 123. The landing seal 246 allows the bottom dart 243*b* to sealingly engage the bottom wiper plug 243*b*. Fluid pressure behind the bottom dart 243*b* will release the bottom wiper plug 120*b* from the top wiper plug 120*u*. In this embodiment, the latch 136 of the bottom wiper plug 120*b* will disengage from the latch profile 126 of the top wiper plug 120*u*.

As the cement and the top dart 243*u* continues to move downward, the top dart 243*u* will initially land in the catcher sleeve 142. In this respect, the second landing shoulder 285 will engage the upper portion of the catcher sleeve 142, and the second landing seal 286 will sealingly engage an inner diameter of the catcher sleeve 142. Continued pumping of the chaser fluid will increase pressure on the seated top dart 243*u*. After reaching a predetermined pressure, a setting force is transmitted to the liner hanger, thereby setting the liner hanger. In one example, the increased pressure will exert pressure on a piston, which in turn exerts a setting force on a polished bore receptacle. The polished bore receptacle will in turn set the liner hanger. Setting of the liner hanger may be confirmed, such as by slacking the workstring.

Continued pumping of the chaser fluid further increases the pressure above the seated top dart 243*u*. At a second predetermined pressure, the second landing shoulder 285 of the top dart 243*u* will deform sufficiently to release the top dart 243*u* from the catcher sleeve 142. In this embodiment, the second landing shoulder 285 will deform inwardly to reduce its outer diameter. The second landing shoulder 285 may bend inwardly into the recess 287 of the dart body 240. As a result, the top dart 243*u* will release from the catcher sleeve 142 to continue traveling downward.

The top dart 243*u* will seat on the landing profile 125 of the top wiper plug 120*u*. In this embodiment, the first landing shoulder 245 will engage the landing profile 125 and the first landing seal 246 will sealingly engage an inner diameter of the top wiper plug 120*u*. Fluid pressure behind the top dart 243*u* will release the top wiper plug 120*u* from the housing 132 of the launcher 130. In this embodiment, the latch 126 of the top wiper plug 120*u* will disengage from the latch profile 134 of the housing 132. In this manner, the top wiper plug 120*u* along with the top dart 243*u* is released downhole.

Continued pumping of the chaser fluid may drive the train of darts 243*u,b*, wiper plugs 120*u,b*, and slurry through the liner bore. The bottom dart and plug 243*b*, 120*b* may land into the collar at the lower end of the liner, and continued pumping of the chaser fluid may rupture the diaphragm of the bottom dart 243*b*, thereby allowing the slurry to flow through the bottom dart and plug 243*b*, 120*b*, and into the annulus. Pumping of the chaser fluid may continue until a desired quantity thereof has been pumped or the top dart 243*u* and top wiper plug 120*u* land onto the bottom dart 243*b* and bottom wiper plug 120*b*. Thereafter, pumping of the chaser fluid may be halted.

In one embodiment, a method of cementing a liner includes releasing a dart behind a cement; landing the dart in an activation seat; increasing pressure to activate a liner hanger; further increasing pressure to release the dart from the activation seat; and landing the dart in a plug.

In one or more of the embodiments described herein, releasing the dart from the activation seat comprises deforming the dart.

In one or more of the embodiments described herein, deforming the dart comprises deforming a landing shoulder of the dart.

In one or more of the embodiments described herein, the method includes disposing a second dart in front of the cement.

In one or more of the embodiments described herein, the second dart includes a rupture disc.

In one or more of the embodiments described herein, the second dart lands in a second plug, and the method includes releasing the second dart and the second plug.

In one or more of the embodiments described herein, the second dart is configured to pass through the activation seat.

In one or more of the embodiments described herein, the dart includes a second landing shoulder having a diameter larger than a first landing shoulder.

In one or more of the embodiments described herein, the method includes releasing the plug with the dart.

In another embodiment, a method of cementing a liner includes releasing a first dart in front of a cement; releasing a second dart behind the cement; landing the second dart in an activation seat; activating a liner hanger; releasing the second dart from the activation seat; landing the first dart in a first plug; releasing the first dart and the first plug; landing the second dart in a second plug; releasing the second dart and the plug; and disposing the cement on an exterior of the liner.

In one or more of the embodiments described herein, the second dart includes a second landing shoulder having a diameter larger than a first landing shoulder.

In one or more of the embodiments described herein, deforming the second dart comprises deforming the second landing shoulder.

In one or more of the embodiments described herein, the method includes landing the first plug on a float collar.

In one or more of the embodiments described herein, the method includes passing the cement through the first plug and out into the exterior of the liner.

In one or more of the embodiments described herein, the method includes landing the second plug on the first plug.

In one or more of the embodiments described herein, a landing shoulder of the first dart is smaller than a first landing shoulder of the second dart.

In one or more of the embodiments described herein, the second dart includes a second landing shoulder that is larger than the first landing shoulder.

In one or more of the embodiments described herein, the second landing shoulder is deformable to decrease its outer diameter.

In one or more of the embodiments described herein, releasing the second dart from the activation seat comprises deforming the dart.

In one or more of the embodiments described herein, deforming the second dart comprises deforming a landing shoulder of the second dart.

In another embodiment, a method of operating a tool includes releasing a dart; landing the dart in a first seat; increasing pressure behind the dart to activate the tool; further increasing pressure to release the dart from the activation seat; and landing the dart in a second seat.

In one or more of the embodiments described herein, the method includes activating a second tool after landing in the second seat.

In one or more of the embodiments described herein, the method includes passing a second dart through the first seat and the second seat.

In one or more of the embodiments described herein, the second dart lands in a third seat, and the method includes activating a third tool after the second dart lands in the third seat.

While the foregoing is directed to embodiments of the present invention, other and further embodiments of the invention may be devised without departing from the basic scope thereof, and the scope thereof is determined by the claims that follow.

We claim:

1. A method of cementing a liner having a liner hanger and disposed in a wellbore, the method comprising:

releasing a top dart into the wellbore after a cement is pumped into the wellbore;

landing the top dart in an activation seat;

applying a pressure to the top dart in the activation seat to activate the liner hanger;

increasing the applied pressure to release the top dart from the activation seat;

landing the top dart in a top plug; and displacing the cement using the top dart and top plug.

2. The method of claim 1, wherein releasing the top dart from the activation seat comprises deforming the top dart.

3. The method of claim 2, wherein deforming the top dart comprises deforming a landing shoulder of the top dart.

4. The method of claim 1, further comprising releasing a bottom dart into the wellbore prior to the cement being pumped into the wellbore.

5. The method of claim 4, wherein the bottom dart includes a rupture disc.

6. The method of claim 4, wherein the bottom dart lands in a bottom plug, and the method includes releasing the bottom dart and the bottom plug.

7. The method of claim 4, wherein the bottom dart is configured to pass through the activation seat.

8. The method of claim 1, wherein the top dart includes a second landing shoulder having an outer diameter larger than an outer diameter of a first landing shoulder.

9. The method of claim 8, wherein the second landing shoulder is deformable to decrease its outer diameter.

10. The method of claim 8, wherein releasing the top dart from the activation seat comprises releasing the top dart and the second landing shoulder from the activation seat.

11. The method of claim 10, further comprising releasing the top plug with the top dart.

12. The method of claim 11, further comprising releasing a bottom dart having a rupture disc into the wellbore prior to the cement being pumped into the wellbore.

13. The method of claim 1, further comprising releasing the top plug with the top dart.

14. The method of claim 1, wherein the top dart includes a fin, and increasing the applied pressure to release the top dart from the activation seat comprises releasing the top dart and the fin from the activation seat.

15. A method of cementing a liner in a wellbore, comprising:

releasing a bottom dart into the wellbore prior to a cement being pumped into the wellbore;

releasing a top dart into the wellbore after the cement is pumped into the wellbore;

landing the top dart in an activation seat;

activating a liner hanger of the liner by applying a pressure to the top dart in the activation seat;

releasing the second top dart from the activation seat;

landing the bottom dart in a bottom plug;

releasing the bottom dart and the bottom plug;

landing the top dart in a top plug;

releasing the top dart and the top plug;

conveying the top dart and the top plug through a bore of the liner; and disposing the cement on an exterior of the liner.

16. The method of claim 15, wherein releasing the top dart from the activation seat comprises deforming the top dart.

17. The method of claim 16, wherein deforming the top dart comprises deforming a landing shoulder of the top dart.

18. The method of claim 17, wherein releasing the top dart from the activation seat comprises releasing the landing shoulder of the top dart from the activation seat.

19. The method of claim 15, wherein a landing shoulder of the bottom dart is smaller than a first landing shoulder of the top dart.

20. The method of claim 19, wherein the top dart includes a second landing shoulder having an outer diameter that is larger than the first landing shoulder.

21. The method of claim 20, wherein the second landing shoulder is deformable to decrease its outer diameter.

22. The method of claim 21, wherein releasing the top dart from the activation seat comprises deforming the second landing shoulder.

23. The method of claim 15, wherein the top dart includes a fin, and releasing the top dart from the activation seat comprises releasing the top dart and the fin from the activation seat.

* * * * *